United States Patent [19]

Anderson

[11] 4,265,301

[45] May 5, 1981

[54] HEAT EXCHANGER SUPPORT CONSTRUCTION

[76] Inventor: James H. Anderson, 1615 Hillock La., York, Pa. 17403

[21] Appl. No.: 933,879

[22] Filed: Aug. 15, 1978

Related U.S. Application Data

[63] Continuation-in-part of Ser. No. 674,675, Apr. 6, 1976, abandoned.

[51] Int. Cl.[3] ..... F28F 9/00

[52] U.S. Cl. ..... 165/162; 248/68 CB

[58] Field of Search ..... 165/162, 172, 178, 159, 165/160, 161; 122/510; 248/68 CB; 176/78, 76

[56] References Cited

U.S. PATENT DOCUMENTS

| | | | |
|---|---|---|---|
| 1,815,750 | 7/1931 | Watts | 165/162 |
| 2,067,671 | 1/1937 | Kooistra | 165/162 |
| 2,505,695 | 4/1950 | Villiger et al. | 165/162 |
| 2,610,832 | 9/1952 | Holmes et al. | 165/162 |
| 3,070,534 | 12/1962 | Kooistra | 176/78 |
| 3,144,081 | 8/1964 | Skiba | 165/162 |
| 3,292,691 | 12/1966 | Welter et al. | 165/172 |
| 3,399,719 | 9/1968 | Forrest et al. | 165/162 |
| 3,438,434 | 4/1969 | Smith | 165/159 |
| 3,442,763 | 5/1969 | Chetter et al. | 165/162 |
| 3,630,276 | 12/1971 | Kikin et al. | 165/161 |
| 3,708,142 | 1/1973 | Small | 165/162 |
| 3,916,990 | 11/1975 | Ruhe et al. | 165/162 |
| 4,042,456 | 8/1977 | Ip et al. | 176/78 |
| 4,056,441 | 11/1977 | Marmonier et al. | 176/76 |
| 4,083,695 | 4/1978 | Haese et al. | 165/162 |

FOREIGN PATENT DOCUMENTS

| | | | |
|---|---|---|---|
| 847179 | 6/1952 | Fed. Rep. of Germany | 165/172 |
| 488944 | 7/1938 | United Kingdom | 165/162 |
| 607717 | 9/1948 | United Kingdom | 165/172 |
| 959470 | 6/1964 | United Kingdom | 176/78 |
| 975297 | 11/1964 | United Kingdom | 176/78 |
| 1005541 | 9/1965 | United Kingdom | 176/76 |
| 1140243 | 1/1969 | United Kingdom | 165/172 |

*Primary Examiner*—Sheldon J. Richter
*Attorney, Agent, or Firm*—Albert L. Gabriel

[57] ABSTRACT

A heat exchanger of the shell and tube type having a floating tube sheet to accommodate differential thermal expansion and contraction between the shell and the tubes. The cross-sectional area of sliding joint means between the floating tube sheet and the shell, and the total external and internal cross-sectional areas of the tubes, are selected to minimize axial forces on the tubes. A novel tube support system including hollow support members engaged between the adjacent tubes enables a true counterflow heat exchange relationship to be established between the shell side fluid and the tube side fluid.

14 Claims, 16 Drawing Figures

FIG. 9
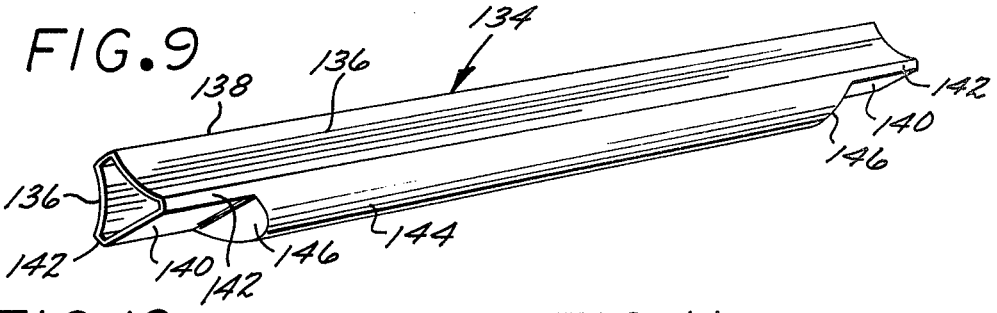
FIG. 10
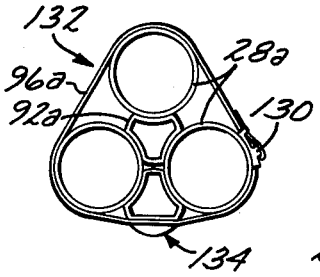
FIG. 11
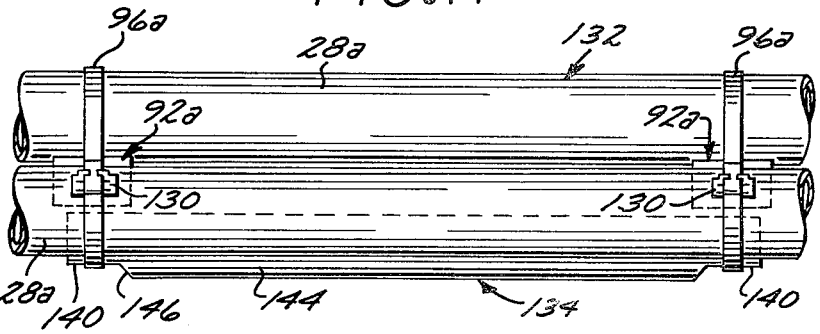
FIG. 12
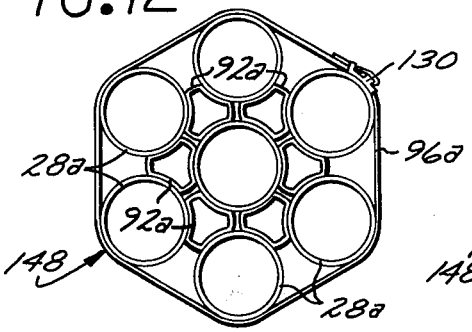
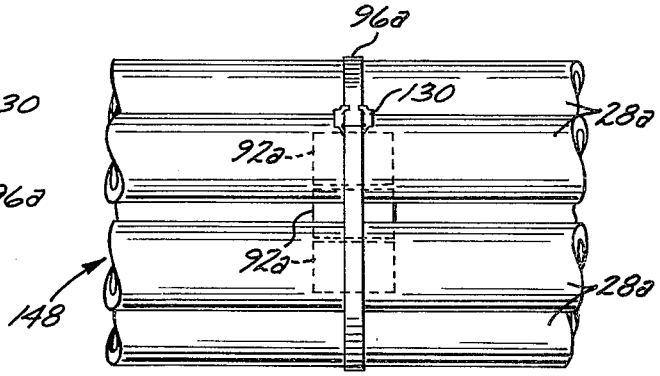
FIG. 13
FIG. 14
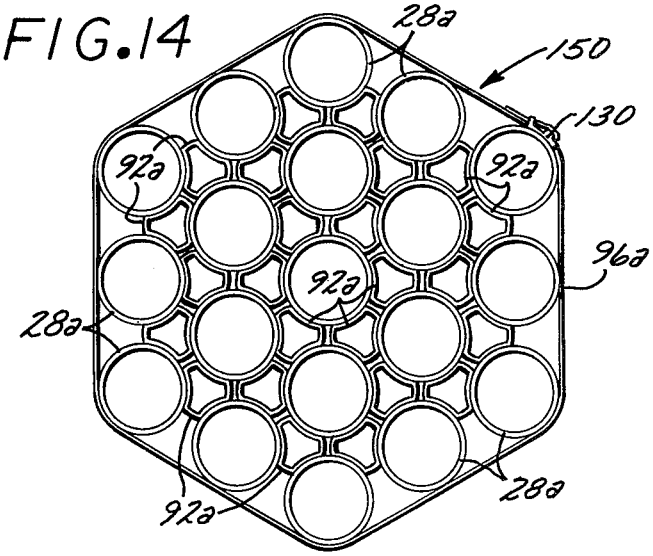
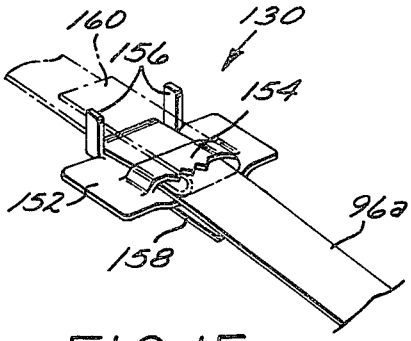
FIG. 15

HEAT EXCHANGER SUPPORT CONSTRUCTION

RELATED APPLICATIONS

This is a continuation-in-part of my co-pending application Ser. No. 674,675, filed Apr. 6, 1976, for HEAT EXCHANGER CONSTRUCTION, now abandoned.

BACKGROUND OF THE INVENTION

1. Field of the Invention

This invention relates to shell and tube type heat exchangers, and more particularly to novel floating head means for balancing fluid forces therein, and to a novel tube support system therefor.

2. Description of the Prior Art

Floating tube sheets are known in the heat exchanger art. In these heat exchangers one of the tube sheets within which the tubes are held is allowed to move axially relative to the shell to accommodate differential axial expansion between shell and tubes. Although floating tube sheets of the prior art eliminate stresses resulting from unequal thermal expansion, they do not balance the forces acting upon the tubes due to the various fluid pressures within the heat exchanger. Therefore, even in floating tube sheet designs of the prior art, stresses still exist because of these unbalanced fluid forces.

To overcome the afore-noted drawback, the prior art teaches the use of relatively thick tubes, which result in higher material costs and have relatively poor heat transfer qualities for the fluids flowing about the tube walls. Additionally, the prior art accepts the danger of failure of at least a percentage of the tubes within the heat exchanger due to stress-produced cracking.

Another disadvantage prevalent in conventional heat exchangers is the fact that they use plates containing a large number of apertures for supporting the tubes at spaced locations along their lengths. However, use of such support plates results in an increase in abrasive wear and tear on the tubes. This abrasive wear is occasioned by the difficulty encountered in obtaining a tight and relatively slippage-free contact between the tubes and support plates.

Furthermore, the support plates direct the heat exchange medium to flow across the tube bundle or bank as opposed to an axial flow path, thereby making true counterflow heat exchange impossible, as well as increasing the pressure drop across the heat exchanger and causing acceleration and deceleration power losses along the length of the heat exchanger. Such increased pressure drop can result in an important power loss through the requirement of increased pumping power where the heat exchangers are employed in a geothermal power plant, particularly where the plant is of the type disclosed in the B. C. McCabe U.S. Pat. No. 3,757,516 which employs down-hole pumping in the geothermal well or wells to restrain geothermal hot water from flashing into steam so as to transfer heat energy at the highest possible temperature in the heat exchangers and to minimize mineral precipitation from the geothermal hot water. Shell side cross-flow of fluid in prior art heat exchanger designs also causes reduced fluid velocities, which, among other things, results in lower heat transfer coefficients.

The various inefficiencies, including those noted above, in prior art cross-flow heat exchanger designs generally require on the order of about twice or more fluid contacting surface than would be required for a true conterflow configuration, resulting in undesirably heavy construction and attendant difficulties in handling and mounting.

Reduced fluid velocities in cross-flow heat exchangers not only results in lower heat transfer coefficients as noted above, but also increases the chances of silting and fouling, and increases the likelihood of corrosion of some tube materials which require high surface velocities to prevent corrosion. Where solids may be entrained in the shell side fluid, prior art cross-flow increases the chances for impingement pitting, and in general increases the erosion effect on the tubes and tube supports in the heat exchanger. Corrosion, fouling and coping with entrained solids are all serious problems in geothermal plant heat exchangers, particularly where the geothermal energy resource is a very hot brine of high chloride and silica content such as is found in California's Imperial Valley.

There are several additional generally structural problems associated with the prior art use of apertured support plates for supporting the tube bundle at intervals along the shell. One very basic problem is that such construction makes assembly of the tube bundle a very difficult, time-consuming, and expensive proposition. Also, the spaced tube support plates have relatively large surface areas of engagement with the outer shell, and thereby do not readily slide relative to the shell, so that they tend to resist adjustment for unequal thermal expansion and thereby introduce undesired stresses throughout the heat exchanger. Further, prior art tube bundle supports generally necessitate a considerable amount of peripheral spacing between the outermost tubes of the bundle and the outer shell, whereby a substantial amount of fluid tends to bypass the desired heat exchange contact with the tubes, and the fluid flow rate correspondingly decreases and pressure drop increases in the region of the interstices between the tubes of the bundle.

The failure of prior art heat exchangers to balance the forces acting upon the tubes due to the various fluid pressures within the heat exchanger, and the generally insecure prior art means for tying and supporting the tube bundle, present particularly critical problems where the heat exchanger is employed in a geothermal energy system of the type disclosed in said McCabe U.S. Pat. No. 3,757,516 where geothermal hot water is normally prevented by pump means from flashing into steam. Should such pump means inadvertently fail, the resultant pressure drop would allow some of the geothermal hot water to flash into steam, and that could collapse again, resulting in severe stressing and possibly even an explosive situation in connection with such prior art heat exchanger.

Further difficulties in the prior art are also encountered in attempting to prevent corrosion in the typical heat exchange components, as well as in providing adequate lubrication for the movable parts therein.

SUMMARY OF THE INVENTION

In order to overcome the aforementioned disadvantage of unbalanced fluid pressure forces acting on the tubes, it is an object of this invention to provide a floating tube sheet which is force-balanced with respect to the pressures created by the fluids within the heat exchanger, thereby minimizing stresses that act upon the tubes. This object is accomplished by (1) a floating tube sheet which is mounted within the outlet or inlet end of the shell of a heat exchanger so as to move axially with respect to the shell of the heat exchanger, and (2) having the internal and external dimensions of the tubes and the dimensions of the heat exchanger at various critical portions so selected that the pressures of the fluids contained within the heat exchanger provide only a relatively minor resultant force upon the heat exchanger tubes. This minor force can also be effective to place the tubes in slight tension.

Another object of the invention is to overcome the disadvantage prevalent in the prior art, wherein a tight connection between the tubes along their lengths cannot be effected without sacrificing a true counterflow heat transfer in the exchanger, as well as increasing the pressure drop of the heat transfer medium flowing therein. This object is achieved by means of a series of simple, but yet effective hollow tube support members or brackets which space the tubes apart and orient the tubes with respect to each other. Each of these tube support members or brackets has a generally triangular periphery, with each of the sides thereof arcuately indented and being adapted to conform to the periphery of the respective tube it is to be in contact with. Groups of tubes thus spaced apart and oriented with a plurality of these tube support members are then tightly banded or strapped together so that all of the tubes are tightly compressed against respective sides of respective support members. A hugging type of contact results that greatly increases frictional contact so that all of the tubes of the tube bundle are tightly locked together in accurately spaced relationship, thereby greatly reducing wear on the tubes. The hollowness of the tube support members or brackets enables true counterflow heat exchange to be achieved between the fluids, while at the same time decreasing the pressure drop of the fluid that passes about the outsides of the tubes.

A further object of the invention is to provide a novel biasing force between the spaced tubes in the tube bundle for further tightness and security of the bundle. This biasing is achieved by providing the hollow tube support members or brackets of the invention of spring material with the arcuately indented sides thereof having a greater radius of curvature than the peripheries of the tubes so that a spring biasing deflection of the sides of the hollow tube support members or brackets occurs when a group of tubes is banded or strapped together.

A still further object of the invention which is achievable by use of the aforesaid novel hollow tube support members or brackets is to provide a greater pitch, or distance, between adjacent tubes along the length of the heat exchanger than the pitch between adjacent holes in the tube sheets at the ends of the exchanger, which minimizes ineffective shell side flow between the outside of the tube bundle and the shell, and improves effective flow between the tubes.

A further object of the invention is to provide novel hollow support feet or skids which are generally similar in construction to the aforesaid triangular support members or brackets, and which are strapped to the outer periphery of the tube bundle for engagement against the inner surface of the outer shell. These support feet or skids provide coaxial location of the tube bundle along its length in the outer shell, while at the same time permitting relative longitudinal sliding between the tube bundle and outer shell along the lengths thereof to accommodate differential thermal expansion and contraction.

Another object of the invention is to provide means that lubricates as well as prevents dirt and other corrosive particles from entering and building up in areas wherein there is relative movement between sliding components in the heat exchanger. This objective is accomplished by establishing a buffer seal of lubricant, such as grease, between the sliding surfaces in the floating head structure of the heat exchanger, with the lubricant being fed to this buffer seal under greater pressure than that of the fluid heat exchange medium adjacent the seal, whereby the buffer seal flushes dirt and other corrosive materials from between these sliding surfaces.

The true counterflow configuration enabled by the novel tube support members or brackets of the present invention generally requires less than one-half the surface that would be required by a cross-flow baffled type design of similar performance, allowing a lighter construction which provides ease in handling and mounting. The novel tube bundle construction and force balancing floating head allow use of the thinnest possible tubing wall, further improving heat transfer, reducing tube cost and lightening the overall weight of the heat exchanger.

The true longitudinal conterflow keeps fluid velocities high, which provides higher heat transfer coefficients than encountered in cross-baffled or U-bundle type heat exchangers. The high fluid velocity also reduces the chances of silting, minimizes fouling, and provides for the proper flow action when using tube materials which require high surface velocities to prevent corrosion. Even with the high fluid velocities, the shell side flow is always essentially parallel to the tubes, reducing the chances for impingement pitting by entrained solids and minimizing the erosion effect on the material of the tubes.

Pressure drop is reduced with the tube bundle construction of the present invention by the absence of baffles or baffle-like supports in the shell side, and the high ratio of flow area to total area. Fluid acceleration and deceleration losses are virtually eliminated because there is substantially zero velocity across the tubes. The reduced pressure drop of the present invention results in a corresponding reduction in pumping power that is required, which provides an important net power gain in a geothermal plant, and particularly in a geothermal plant of the type disclosed in said McCabe U.S. Pat. No. 3,757,516 which employs down-hole pumping to restrain the geothermal hot water from flashing into steam.

The present invention is particularly useful in a binary geothermal power system of the type disclosed in said McCabe U.S. Pat. No. 3,757,516 or James Hilbert Anderson U.S. Pat. No. 3,795,103, heat energy being transferred through heat exchangers of the present invention from geothermal hot water or brine which is preferably flowed through the shell side of each exchanger to a "working" or "operating" fluid such as isobutane, the refrigerant R22, butane, or the like which is flowed through the tube side of the exchangers and is expanded in a power extracting gas expansion device such as an expansion turbine to generate electricity. All of the aforesaid advantages of the present invention are particularly applicable in a geothermal power system where it is important to extract a maximum of power from the available flow volume and temperature, where the geothermal fluid is likely to be corrosive and to contain entrained solids, and where relatively high pressure differentials may be present between the shell side fluid and the tube side fluid whereby force balancing is important, and where the pressure differential could possibly become even more severe as a result of a pump failure or other failure in the system.

An additional important advantage of the present invention is the relative ease and economy with which a tube bundle containing even a very large number of tubes may be constructed pursuant to the invention.

BRIEF DESCRIPTION OF THE DRAWINGS

These and other objects of the invention will become more apparent in reference to the following description and the accompanying drawings, wherein:

FIG. 9 is a perspective view of a support foot or skid according to the invention which is employed in a peripheral position on a tube bundle to slidingly support the bundle against the inner surface of the outer heat exchanger shell;

FIG. 10 is a cross-sectional view similar to FIG. 8, but illustrating the addition of a support foot or skid of the type shown in FIG. 9;

FIG. 11 is a fragmentary side elevational view of the assembiy shown in FIG. 10;

FIG. 12 is a cross-sectional view illustrating an assembled, banded group of seven heat exchanger tubes in a hexagonal array wherein six of the tubes are supported by six support members or brackets about a central tube;

FIG. 13 is a fragmentary side elevational view of the group of seven tubes shown in FIG. 12;

FIG. 14 is a cross-sectional view of a group of nineteen heat exchanger tubes and twenty-four support members or brackets banded together in a generally hexagonal array;

FIG. 15 is a perspective view illustrating a band clamp of a type suitable for tightly securing a band about a heat exchanger tube group or bundle.

DETAILED DESCRIPTION

Figure 1:
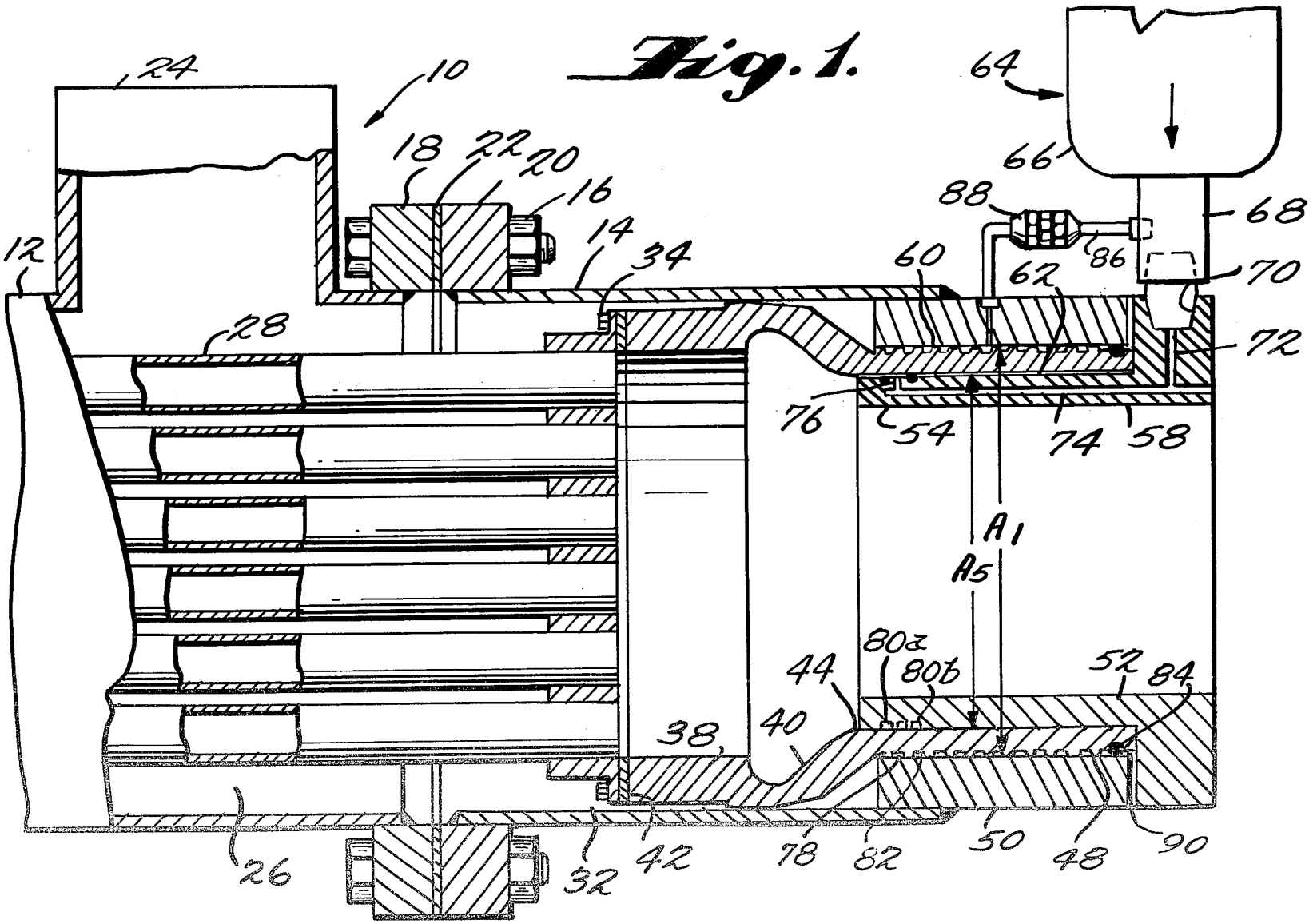
FIG. 1 is a fragmentary longitudinal, vertical section, with portions shown in elevation, illustrating one form of heat exchanger made in accordance with the principles of the invention.

Referring to FIG. 1, there is shown a heat exchanger 10 that includes a cylindrical shell 12 which is detachably fastened to an outer shell head 14 by means of a conventional bolt connection 16, which extends between flanges 18 and 20, respectively. Interposed between these flanges 18 and 20 is any of a typical type of sealing means, such as in this instance a gasket 22. A liquid inlet conduit 24 is provided in the body of the shell 12 so as to permit the passage therethrough of a fluid medium, such as geothermal hot water or brine. A tube bundle or bank 26 contains a plurality of tubes 28 that are disposed within the confines of the shell 12. The right-hand ends of the tubes as viewed in FIG. 1 are affixed within apertures 30 in a tube sheet 32 by any suitable means, as for example being expanded after insertion into the apertures 30. The tube sheet 32 is attached by conventional means, such as bolts 34, at its periphery to the forward end portion 38 of a floating head piston 40. A sealing gasket 42 is placed between the tube sheet 32 and floating head piston 40. The opposite ends of the tubes 28 may be considered as fixed as in a conventional heat exchanger.

A passageway 44 in the floating head piston 40 extends from the forward end portion 38 to a rearward end portion 46, thereby providing a conduit for the passage of liquid, as for example a binary working or power fluid in a geothermal power system such as isobutane, the refrigerant R-22, butane, or the like. This passageway or conduit 44 communicates with the interiors of the tubes 28. The rearward end portion 46 of the floating head piston 40 is axially aligned with an annular space 48 defined between the inner surface of a hollow cylindrical end member or floating head cylinder 50 and the outer surface of a hollow flange structure 52. The end member or cylinder 50 is welded or otherwise secured to the outer shell 14. The flange structure 52 has a tubular body portion 54 and an annular rim 56 which is secured by means (not shown) to the end member or cylinder 50. A passageway 58 extends through the tubular flange body 54 which is coaxial to and communicates with the passageway 44 located within floating head piston 40. There is a first bore or cylindrical surface 60 that extends along the internal periphery of the end member or cylinder 50 and has a cross-sectional area equivalent to A1. The internal periphery of rearward end portion 46 of floating head piston 40 defines a second bore or cylindrical surface 62 having a cross-sectional area equivalent to A5, the external periphery of flange body portion 54 also having substantially this same cross-sectional area A5. A sliding joint is established by the rearward end portion 46 of floating head piston 40 being capable of movement in the annular space 48 defined between the end member or cylinder 50 and the flange body portion 54. The external surface of the piston end portion 46 is provided with square threads which slide in the bore 60 of the end member or cylinder 50 as part of the lubrication system hereinafter described.

A lubrication means 64 provides lubricant to the sliding surfaces in the annular space 48. The lubricant, such as grease, protects the sliding joint from corrosion and also reduces the coefficient of friction between the sliding surfaces.

A hydraulic accumulator 66, or other suitable lubricant supply device, is attached by a fitting 68 to an opening 70 located in the annular end 56 of the flange structure 52. A radial duct 72 extends from opening 70 to a passageway 74. Duct 76 located at the forward end of passageway 74 extends radially outwardly to a circular groove 78 located between an inner seal which is defined by a pair of sealing rings 80*a, b*. There is also formed an outer seal located on the external periphery of rearward end portion 46 of floating head piston 40. This outer seal is defined by (1) screw threads 82 which run along the external peripheral surface of floating head piston 46 so as to effect a labyrinth seal and (2) a sealing ring 84 located at rearward end 46.

Lubricant is fed to the outer seal by traveling from the accumulator 66 through a tube 86 to a throttling orifice 88. This throttling orifice 88 is a well known Visco Jet and is effective to control the flushing rate of lubricant flow to the outer seal.d By controlling the pressure at which lubricant is supplied to the outer seal, so that pressure thereof is in excess of the fluid pressure of the corrosive hot water in the outer shell 14, any corrosive particles such as dirt are prevented from building up on the sliding surfaces. It is to be noted that a flushing flow of lubricant is not required in the inner seal because of the normally non-corrosive fluid that flows through the tubes 28. However, if a corrosive fluid medium does travel through the tubes, the inner seals can be structurally modified so as to conform to the arrangement of the outer seal as well as increasing the flushing flow of lubricant thereto. Vent means 90 is provided in the end member 50 to communicate the annular space 48 with the ambient pressure.

In order to relieve stresses acting on the tubes 28 due to an unequal thermal expansion between the tubes and the shell, the floating head piston 40 is constructed so as to be axially movable in the annular space 48. In the heat exchanger construction as viewed in FIG. 1, the following force equation describes the total axial forces exerted upon the tubes 28 as a result of the fluids within the heat exchanger 10, as well as the atmospheric pressure acting in annular space 48 through the vent means 90:

$$F=P_s(A_4-A_1)+P_t(A_5-A_3)+P_a(A_1-A_5)$$

where $P_s$ is the pressure of the shell side fluid in the heat exchanger, $P_t$ is the pressure of the tube side fluid in the heat exchanger, $P_a$ is the ambient pressure acting through vent means 90, $A_4$ is the total cross-sectional area of th external diameters of tubes 28, $A_3$ is the total cross-sectional area of the inner diameters of the tubes 28, $A_1$ is the cross-sectional area of the heat exchanger at bore or cylindrical surface 60, and $A_5$ is the cross-sectional area of the heat exchanger at bore or cylindrical surface 62.

In the above equation, the forces developed normally produce a compression force on the tubes, and if F is positive, this indicates a compression force on the tubes. Thus, for example, as viewed in FIG. 1, the pressure of the atmosphered acts against the area ($A_1-A_5$) and pushes the floating head piston 40 and the attached tube sheet with the tubes leftwardly. The minus forces generated in the above equation produce a tension force on the tubes. For example, the tube fluid active in the area $A_3$ tends to push the tubes rightwardly, as viewed in FIG. 1.

With the foregoing equation in mind, by constructing the exchanger such that the area A4 is made to be equal to the area A1, the pressure of the shell or first body of fluid produces no stress in the tubes. In addition, by making the area A5 slightly smaller than area A3, the applicant has caused the tube or second body of fluid to produced a slight tension force upon the tubes 28. Thus, the tension force produced by the tube fluid is sufficient to overcome the very slight compression effect resulting from the pressure of the atmosphere acting upon the area defined within the annular chamber 48 (A1−A5). By so selecting these areas, the tubes 28 can be force-balanced with respect to the fluid pressure within the heat exchanger which will reduce stresses and lower the chances of weakening by stress corrosion and/or breakage of the tubes 28 in the tube bundle 26 when used in the heat exchanger. Furthermore, this force-balancing enables the tubes 28 to be thinner in wall thickness than conventional tubes, thereby reducing material costs and improving the heat transfer coefficient.

Referring to the above equation, beneficial force-balancing of the tubes occurs whether shell side and tube side pressures are equal or not. While the invention can easily be adapted to an equalized pressure system, such as shown in U.S. Pat. No. 3,312,063, it is not restricted to such environment.

Figure 2:
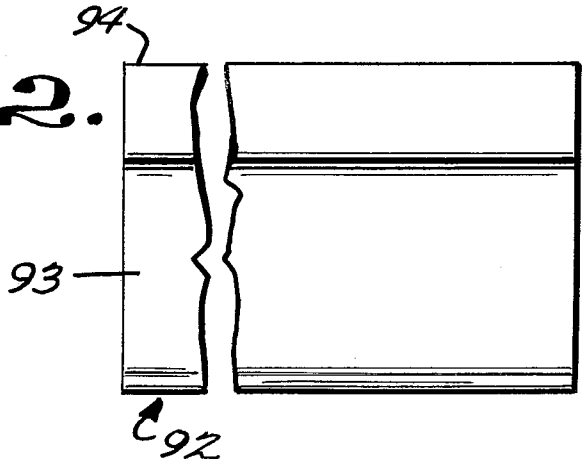
FIG. 2 is a side elevational view of a tube support member or bracket of the invention, with a portion broken away.
Figure 3:
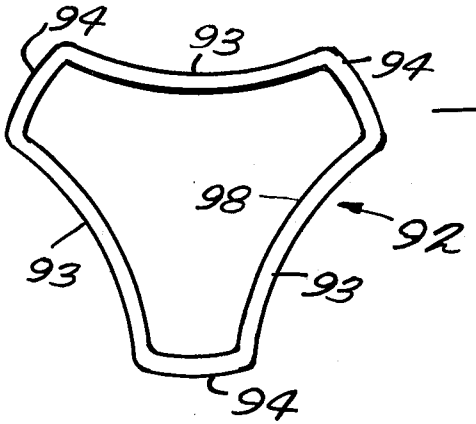
FIG. 3 is a cross-sectional view of the tube support or bracket shown in FIG. 2.

Referring now to FIGS. 2 and 3, each of the tube support brackets or spacers 92 of the present invention is illustrated as being a hollow tubular member having three nodes 94, and three arcuate concave-shaped surfaces 93 that extend between the nodes 94. The arcuate-shaped surfaces are arranged to conform to the external configuration of the tubes 28 when the tubes are strapped or banded together. Bands or straps 96, which may be made of carbon steel, stainless steel, or other suitable material, are secured at each end thereof by conventional means, such as screw thread means, so as to bind three tubes to a single support member or bracket 92. The tight fit so realized by the brackets 92 improves over the fit provided by typical support plates currently utilized in the art, because the brackets 92 due to their configuration are better able to frictionally engage the surfaces of the tubes than are the small apertures located within the conventional support plates. Therefore, by having a frictional contact between the brackets 92 and the tubes 28, vibration and wear are greatly minimized. In an alternative arrangement shown in FIG. 12 and described further in connection therewith, a single central tube 28 is concentrically surrounded by an array of six more tubes 28 with six brackets 92 disposed between the central tube 28 and the array, each bracket 92 having one of its surfaces 93 engaging the central tube 28 and its other two surfaces 93 engaging two of the surrounding tubes 28.

Figure 4:
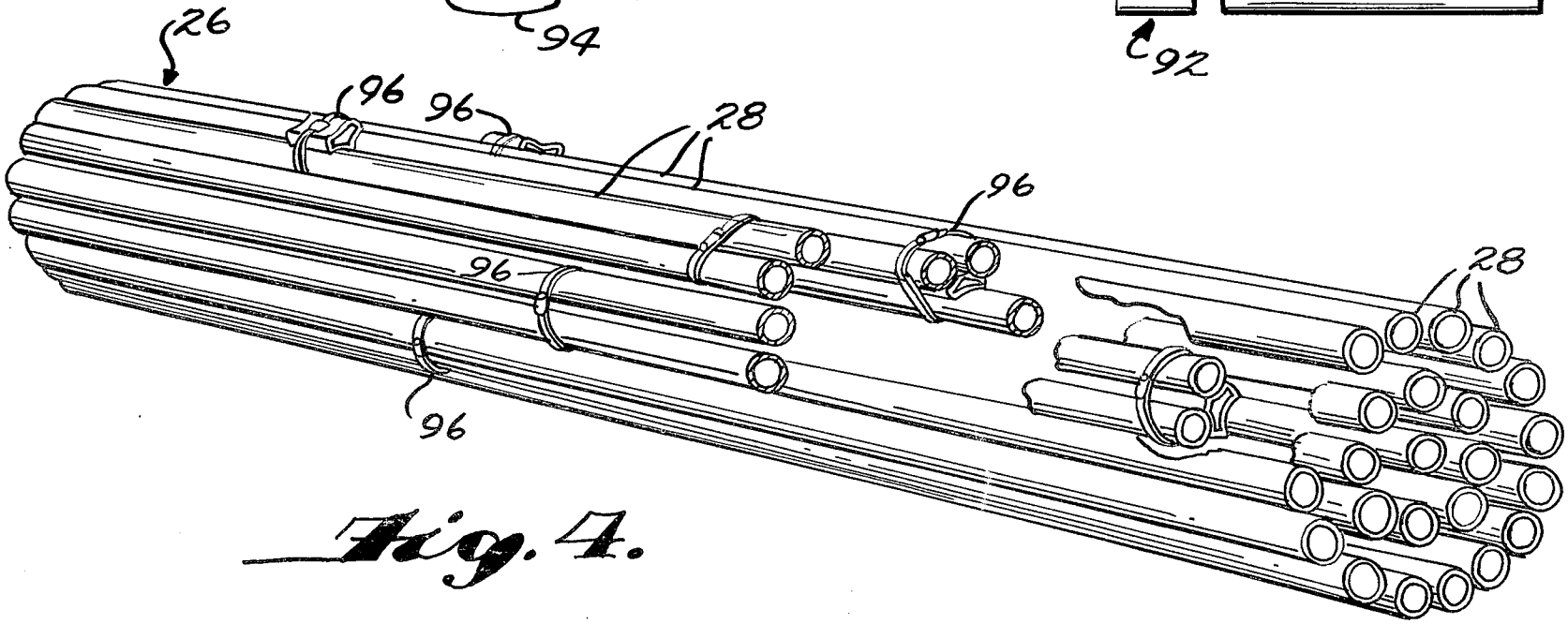
FIG. 4 is a perspective view, with portions broken away, showing a helical arrangement of the tube support members or brackets of FIGS. 2 and 3 on a tube bundle.

Additionally, the hollow interior 98 of the support member or bracket 92 facilitates the transmittal of fluid passing in an axial direction parallel to the tube bundle so that the heat exchanger achieves true counterflow between the shell side and tube side fluids traveling therein. By permitting the fluid to flow parallel to the tubes 28, as opposed to transversely about thes tubes, a high velocity is reached and a small pressure drop results. As aforenoted, the typical support plates promote a transverse movement of the fluid about the tubes, and this transverse movement increases pressure drop as well as decreases velocity of the shell side fluid. Another practical advantage that is effected by use of the hollow support members or brackets 92 is that longer tube bundles, for example up to 150 feet in length, can be effectively supported. As is seen in FIG. 4, both the interior and the exterior portions of tube bundle 26 are supported by a helical arrangement of the support brackets 92. The particular helical arrangement of the brackets 92 is capable of inducing a slight helical mixing action in the shell side fluid as it passes about the tubes 28 without materially reducing velocity or increasing pressure drop. The purpose of this helical circulatory mixing is to prevent stratification of the shell side fluid. The brackets on the exterior surface of the tube bundle 26 serve to center and support the bundle 26 with respect to the tube shell. Special support feet or skids may be employed on the outside of the tube bundle in lieu of the external brackets illustrated in FIG. 4, as shown in FIGS. 9–11 and 16 and described in connection therewith. The interiorly disposed brackets 92 serve to uniformly space the tubes from one another and to support the tubes.

Figure 5:
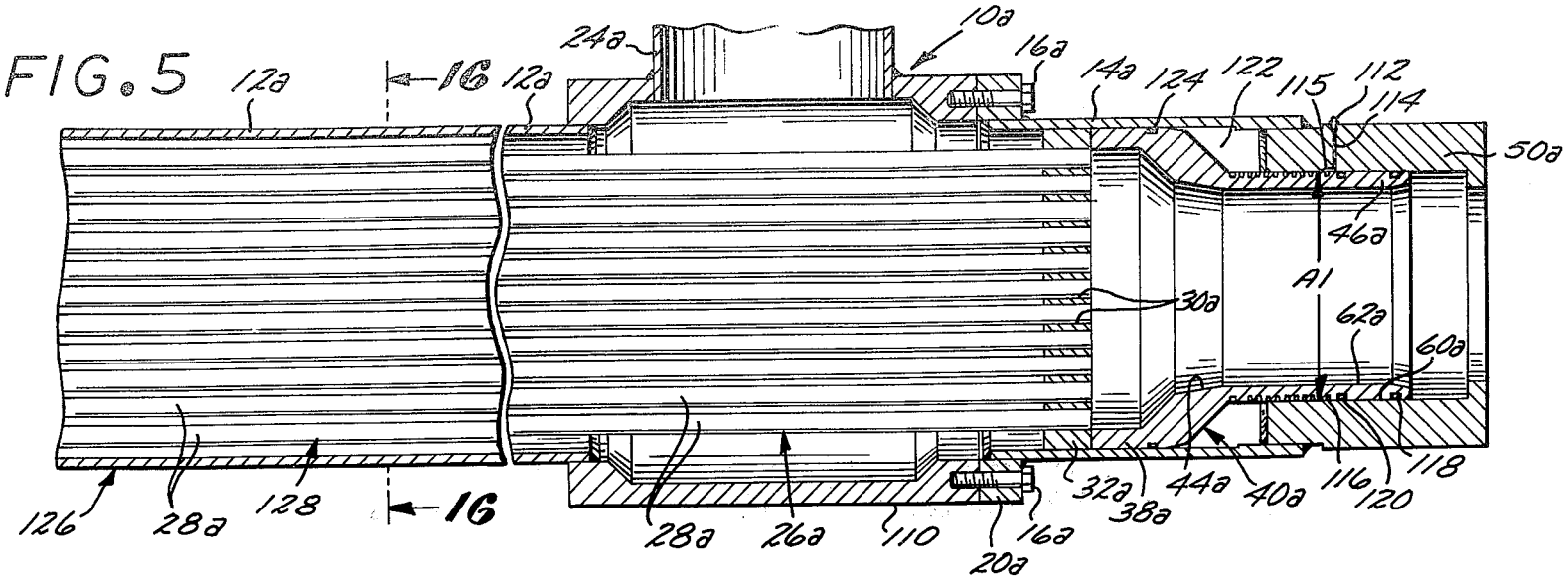
FIG. 5 is a fragmentary longitudinal, vertical section with a portion broken away and partly in elevation, similar to FIG. 1 but illustrating another form of heat exchanger according to the invention.

Referring now to FIG. 5 of the drawings, the heat exchanger 10*a* which is there illustrated has a force balancing floating head type construction which is similar to that of the heat exchanger 10 shown in FIG. 1 but somewhat simplified by removal of the stationary inner tubular body 54 located concentrically within the rearward end portion 46 of the floating head piston 40 in heat exchanger 10 of FIG. 1.

Heat exchanger 10*a* of FIG. 5 includes a cylindrical shell 12*a* which is detachably fastened to an outer shell head 14*a* by means of a bolt connection 16*a* which extends between a flange 20*a* on outer shell head head 14*a* and one end of an inlet collar 110, the other end of which is connected to the cylindrical shell 12*a*. Suitable sealing means (not shown) is interposed between the flange 20*a* and inlet collar 110. A liquid inlet conduit 24*a* contacts with inlet collar 110 so as to permit the passage into the cylindrical shell 12*a* of a tube side fluid medium, such as geothermal hot water or brine. A tube bundle or bank 26*a* contains a plurality of tubes 28 that are arranged to extend longitudinally through the cylindrical shell 12*a*, being uniformly spaced apart from each other across substantially the entire cross-sectional area within cylindrical shell 12*a*, whereby the tube side fluid will flow longitudinally through the interstices between the tubes 28*a*. The right-hand ends of the tubes 28*a* as viewed in FIG. 5 are affixed within apertures 30*a* in a tube sheet 32*a* by any suitable means, as for example being expanded after insertion into the apertures 30*a*. The tube sheet 32*a* is attached by conventional means, such as bolts (not shown) at its periphery to the forward end portion 38*a* of a floating head piston 40*a*. Sealing means, such as a sealing gasket (not shown) may be disposed between the tube sheet 32*a* and floating head piston 40*a*. The opposite ends of the tubes 28*a* may be located in a fixed tube sheet as in a conventional heat exchanger.

A passageway 44*a* in the floating head piston 40*a* extends from the forward end portion 38*a* to a rearward end portion 46*a*, thereby providing a conduit for the passage of a second fluid medium, as for example a binary working or power fluid in a geothermal power system such as isobutane, refrigerant R22, butane, or the like. This passageway or conduit 44*a* communicates with the interiors of the tubes 28*a*. Rearward end portion 46*a* of floating head piston 40*a* is axially slidable in a hollow cylindrical end member or floating head cylinder 50*a* which is welded or otherwise secured to the sheel head 14*a*, in order to accommodate differential axial thermal expansion and/or contraction between the outer shell structure on the one hand and the inner tubes 28*a* on the other hand. The bore or cylindrical surface 60*a* that extends along the internal periphery of the end member or cylinder 50*a* has a cross-sectional area equivalent to A1. The internal periphery of rearward end portion 46*a* of floating head piston 40*a* defines a second bore or cylindrical surface 62*a*. The cross-sectional area of the bore or cylindrical surface 62*a* is not a factor in the force equation for the floating head construction of heat exchanger 10*a* illustrated in FIG. 5, although the corresponding bore or cylindrical surface is, as seen hereinabove, a factor in the force equation for the floating head construction of the heat exchanger 10 illustrated in FIG. 1.

A buffer seal between end member or cylinder 50*a* and piston end portion 46*a* is provided by lubricant such as grease which is injected through a grease port 112 and communicating duct 114 and relief 115 to screw threads 116 on the external cylindrical surface of piston end portion 46*a*. A pair of sealing rings 118 and 120 on the outside of rearward end portion 46*a* of floating head piston 40*a* are located rearwardly of the grease duct 114 so that the injected grease will flow annularly and forwardly through the helical channel of the screw threads 116 into the annular space 122 which is defined between the outer shell head 14*a* and end member or cylinder 50*a* on the one hand and floating head piston 40*a* on the other hand. The annular space 122 thereby becomes filled with grease which provides an excellent buffer seal preventing corrosive shell side fluid, such as geothermal brine, from reaching the sliding joint between end member or cylinder 50*a* and rearward end portion 46*a* of floating head piston 40*a*. A grease barrier ring 124 is provided on the outer periphery of forward end portion 38*a* of floating head piston 40*a*. Grease barrier ring 124 is preferably notched or split to allow a flow of grease to solidly fill the annular space 122, but nevertheless enabling ring 124 to serve as a barrier against substantial flow of grease forwardly between forward end portion 38*a* and the inner circumference of outer shell head 14*a*.

In the heat exchanger construction illustrated in FIG. 5, the following force equation describes the total axial forces exerted upon the tubes 28*a* as a result of the fluids within the heat exchanger 10*a*:

$$F = Ps(A4 - A1) + Pt(A1 - A3)$$

where Ps is the pressure of shell side fluid in the heat exchanger, Ptf is the pressure of the tube side fluid in the heat exchanger, A4 is the total cross-sectional area of the external diameters of tubes 28*a*, A3 is the total cross-sectional area of the inner diameters of the tubes 28*a*, and A1 is the cross-sectional area of the heat exchanger at bore or cylindrical surface 60*a* in the cylindrical end member 50*a*.

This force equation for the axial forces exerted upon the tubes 28*a* will be seen to differ from the corresponding force equation set forth hereinabove for the heat exchanger 10 shown in FIG. 1, in that the present force equation for heat exchanger 10*a* of FIG. 5 does not include a third expression for a force caused by atmospheric pressure, inasmuch as atmospheric pressure is not admitted into the heat exchanger 10*a* to exert any force upon the rearward end portion 46*a* of floating head piston 40*a*, the rearward end of cylindrical end member 50*a* of the shell structure being sealed against atmospheric pressure in its connection to piping (not shown) which carries the tube side fluid. The present force equation for heat exchanger 10*a* of FIG. 5 further differs from the force equation for the heat exchanger 10 of FIG. 1 in that the present equation does not have any term corresponding to A5 of the previous equation, the area circumscribed by the bore or cylindrical surface 62*a* in piston end portion 46*a* not being relevant to the axial forces upon the tubes 28*a*. As with the previous force equation, in the above force equation for axial forces on the tubes 28*a* in heat exchange 10*a* of FIG. 5, the forces developed normally produce a compression force on the tubes 28*a*, and if F is positive, this indicates a compression force on the tubes 28*a*.

The following is a practical example of how the present force equation applies in a heat exchanger which applicant has engineered for use in a prototype geothermal hot water generating plant to be constructed in the Imperial Valley in California, the following being given by way of example only, and not by way of limitation: The heat exchanger contains a bundle of 109 tubes in an array like that shown in cross section in FIG. 16, each tube having a 1.187 inch outside diameter and a 1.117 inch inside diameter. Thus, the total outside cross-sectional area of the tubes corresponding to A4 in the above equation is 120.6 square inches, and the total inside cross-sectional area of the tubes corresponding to A3 in the above equation is 106.8 square inches. In this example, the cross-sectional area at bore or cylindrical surfaces 60*a* corresponding to A1 in the above equation is 113 square inches (corresponding to a diameter of 12 inches).

It will be assumed for the purpose of the present example that this heat exchanger will be employed in the boiler or vaporizer stage of a binary generating system similar to that shown in FIGS. 1–4 of the aforesaid McCabe U.S. Pat. No. 3,757,516, wherein the pressure Ps for shell side geothermal hot water would be approximately 160 psia, and the pressure Pt for tube side isobutane would be approximately 500 psia. To simplify the computation, it will be assumed that Pt equals 3 Ps, which is a close approximation for the values Pt equals 500 psia and Ps equals 160 psia. Putting these values in the formula $F=Ps\ (A4-A)+Pt\ (A1-A3)$, the formula would develop as follows:

$$F=P_s\,(120.6-113)+3\ P_s\,(113-106.8),\ \text{or}$$

$$F=160\ (7.6)+480\ (6.2),\ \text{or}$$

$$F=1216+2976=4192\ \text{lbs.}$$

Such a total compressive force on the heat exchanger tubes 28*a* is relatively small, as can be seen by dividing the force by the total cross-sectional area of the tube walls in the example, which is 13.8 square inches, to give a force of 303.8 pounds per square inch.

For any expected pressures $P_s$ and $P_t$ in a system, a heat exchanger 10*a* according to the invention can have the parameters A1, A3 and A4 arranged to produce a small compressive force on the tubes 28*a* as in the foregoing example, or a small tension force on the tubes, or for the forces in the heat exchanger to balance out so that F=0 in the equation. In the foregoing example where A4=120.6 square inches, A3=106.8 square inches, and $Pt=3\ P_s$, adjustment of the area A1 to 100 square inches would substantially balance the forces in the heat exchanger 10*a*.

The manner in which the internal tubes are spaced and supported relative to each other, and are grouped in the formation of a tube bundle like the bundle 26*a* of FIG. 5, and the manner in which the bundle 26*a* is supported in the outer shell 12*a*, are illustrated in FIGS. 6–16 of the drawings. One overall feature of the tube bundle 26*a* which is permitted by applicant's novel tube support system is that the support system enables the pitch or spacing between adjacent tubes 28*a* in the bundle 26*a* to be greater than the pitch between adjacent holes 30*a* in the tube sheet 32*a*, while still enabling the required amount of peripheral material to be present in the tube sheet within the confines of the shell head 14*a*. Thus, as seen in FIG. 5, the pitch or distance between adjacent tubes 28*a* in th broken away section of the heat exchanger at the left end of FIG. 5 along the main body 126 of shell 12*a* and the main body 128 of the tube handle 26*a* is greater than the corresponding pitch between the holes 30*a* in tube sheet 32*a* and between the tubes 28*a* adjacent tube sheet 32*a*. The tubes 28*a* bow outwardly from their closer positions at the tube sheet 32*a* to the greater pitch and extend along substantially the entire length of the heat exchanger at the greater pitch, then bowing back inwardly to the lesser pitch at the tube sheet (not shown) at the other end of the heat exchanger. This enables the outer tubes 28*a* to be set closer to the shell 12*a* along the main body 126 of shell 12*a* then they would be if they had the same pitch along the tube bundle as at the tube sheet, which minimizes ineffective shell side flow between the outside of the tube bundle 26*a* and the shell 12*a*. The interstitial spaces between the tubes are correspondingly increased in cross section, thus improving effective flow between the tubes.

Figure 8:
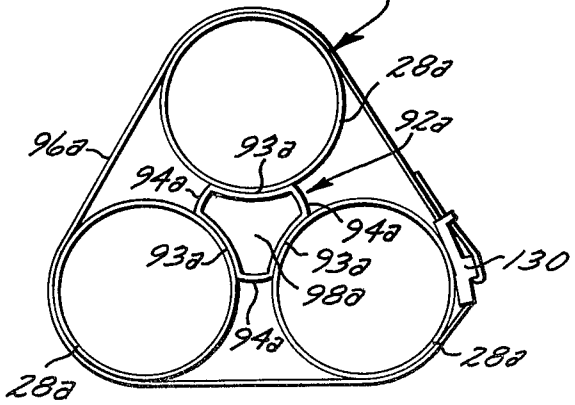
FIG. 8 is a cross-sectional view illustrating the support member and three tubes of FIG. 7 tightly banded or strapped together.
Figure 7:
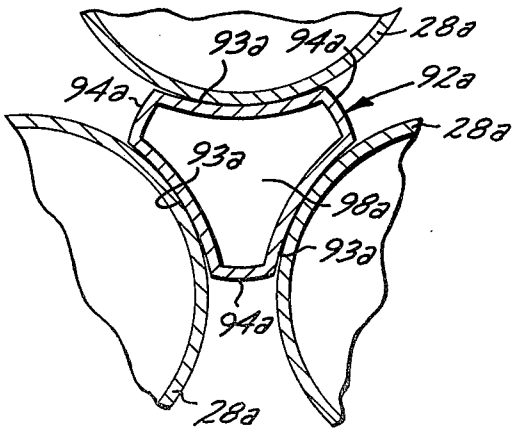
FIG. 7 is a fragmentary cross-sectional view illustrating the preliminarily engaged relationship between a tube support member or bracket of the invention and three heat exchanger tubes before the tubes are tightly banded together, illustrating the larger radius of curvature of each of the arcuately indented or dished sides of the triangular support member than the external radius of curvature of the tube engaged therewith.
Figure 6:
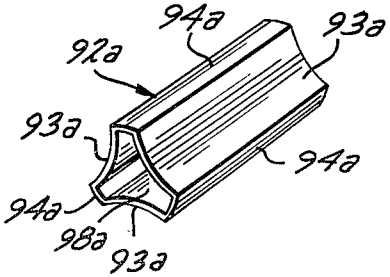
FIG. 6 is a perspective view of a tube support member or bracket according to the invention.

FIGS. 6, 7 and 8 illustrate a novel spring biasing feature which may be embodied in the tube support system of the present invention to achieve further tightness and security of the tube bundle. This spring biasing feature is illustrated in FIGS. 6, 7 and 8 in connection with only a single tube support member or bracket 92*a*, but it will be understood that this feature can be embodied in any or all of the tube support members or brackets 92*a* in a tube bundle.

As seen in FIG. 6, a tube support member or bracket 92*a* according to the invention is a thin walled, tubular structure which may have greater length than width to make handling easier during assembly of the tubes, and to provide the desired strength and resiliency while nevertheless maintaining thin walls to minimize obstruction to the free axial flow of shell side fluid.

The tube support member or bracket 92*a* is of generally equilaterial triangular cross-sectional configuration, having three sides presenting outwardly facing concave, arcuate cylindrical surfaces 93*a* that extend between three nodes or apexes 94*a*. The tube support member or bracket 92*a* has a hollow interior 98*a* permitting the free axial flow of shell side fluid therethrough. The tube support member or bracket 92*a* is made of spring material, as for example a spring steel, and the manner in which this spring material is utilized in the invention to effect biasing force in a tube bundle is illustrated in the sequence of FIGS. 7 and 8. As seen in FIG. 7, which shows three of the heat exchanger tubes 28*a* preliminarily engaged against the respective three concave surfaces 93*a* of tube support member 92*a*, prior to tightening of a band or strap about the tubes 28*a*, the concave, arcuate cylindrical surfaces 93*a* of support member 92*a* have a greater radius of curvature than the outer peripheral surfaces of the tubes 28*a*. Then, as shown in FIG. 8, when a band or strap 96*a* is looped around the three tubes 28*a* and tightened by means of a suitable clamp 130, the outer peripheries of the tubes 28*a* deflect the sides of tube support member 92*a* inwardly against the spring force thereof until the concave surfaces 93*a* conform in curvature to the outer peripheral surfaces of tubes 28*a*. The resulting group 132 of three tubes 28*a* shown in FIG. 8 is thus a tight, internally biased unit of generally triangular cross section wherein the band or strap 96*a* is always kept in tension in the tube bundle and the tubes 28*a* are secure against relative shifting.

FIGS. 9, 10 and 11 illustrates a novel hollow support foot or skid 134 of the invention and the manner in which it is strapped to the outer periphery of a tube bundle for engagement against the inner surface of the heat exchanger shell. The support foot or skid 134 is generally similar in construction to one of the tube support members or brackets 92*a*, but is adapted for only two of its sides to engage against respective two tubes 28*a* while the third side, facing outwardly in a peripheral location on a tube bundle, has end portions thereof adapted to be gripped by a band or strap, with the intermediate portion projecting outwardly beyond the tubes for engagement against the heat exchanger for supporting the tube bundle.

Referring now to the details of construction of the support foot or skid 134, it is a thin-walled, hollow tubular structure to minimize interference with the free axial flow of shell side fluid, and two of its sides present external concave, arcuate cylindrical surfaces 136 which are the same as the corresponding surfaces 93*a* of tube support member or bracket 92*a*, and which may also have greater radiuses of curvature than the outer peripheral surfaces of tubes 28*a* which, in combination with spring material the walls of support foot or skid 134 provides a biasing action to secure the support foot or skid 134 against longitudinal slipping when it is strapped into position between a pair of the tubes 28*a*. The two concave surfaces 136 converge toward a single node or apex 138 which is adapted to project inwardly of a tube bundle and to lie between a pair of peripheral tubes 28*a* of the bundle as best seen in FIG. 10.

The third side of the generally triangular (in cross section) support foot or skid 134 includes a pair of flat surfaces 140 adjacent the respective ends of support foot or skid 134, the flat surfaces 140 being adapted to face outwardly of a tube bundle and each being engageable by a band or strap 96*a* as seen in FIGS. 10 and 11 to secure the support foot or skid 134 in its operative position. As best seen in FIG. 10, the flat surfaces 140 proximate the ends of support foot or skid 134 are arranged to project outwardly beyond a tangent line between the outer peripheries of the two tubes 28*a* between which the support foot 134 is engaged, whereby tension in each of the straps 96*a* provides an inward force component (upwardly directed in FIGS. 10 and 11) against the support foot or skid 134 to secure the latter in its operative position. The flat surfaces 140 are each separated from the two concave surfaces 136 by a pair of nodes or apexes 142.

On the outwardly facing side of support foot or skid 134 between the flat end surfaces 140 is a convex, arcuate, outwardly projecting surface 144 which projects outwardly well beyond the straps 96*a* and is adapted for engagement against the inner periphery of the heat exchanger shell. The convex, outwardly projecting surface 144 terminates at its ends in a pair of inclined end ramps 146 which prevent the ends of the outwardly projecting surface 144 from scraping the inside of the heat exchanger shell, and facilitate a sled-runner type of sliding action which minimizes friction between the tube bundle and shell along the length of the heat exchanger, and correspondingly minimizes stresses induced by differential thermal expansion and/or contraction in the heat exchanger.

Support foot or skid 134 is preferably banded or strapped as a part of a group 132 of three tubes 28*a* arranged about a single tube support member or bracket 92*a* as described hereinabove in connection with FIGS. 7 and 8.

FIG. 12 illustrates a banded or strapped group 148 of seven tubes 28*a* in a concentric, generally hexagonal array wherein the tubes 28*a* are spaced and located by six of the tube support members or brackets 92*a* annularly arranged about a central tube 28*a*, with six of the tubes 28*a* being peripherally located. The group 148 of seven tubes 28*a* is secured by peripheral band or strap 96*a* which is tightened and locked at clamp 130.

A still further banded or strapped group of heat exchanger tubes 150 is shown in FIG. 14, and consists of nineteen tubes 28*a* in a concentric, generally hexagonal arrangement, the tubes 28*a* being located in uniformly spaced-apart relationship by means of twenty-four of the support members or brackets 92*a* and peripheral band or strap 96*a* tightened and locked at clamp 130.

It is to be understood that each of the tube groups 132 (of three tubes 28*a* shown in FIG. 8 without a support foot and in FIGS. 10 and 11 with a support foot 134), 148 (of seven tubes 28*a* shown in FIGS. 12 and 13), and 150 (of nineteen tubes 28*a* shown in FIG. 14) is adapted to be disposed in a heat exchanger shell with other tube groups having either the same or a different number of tubes therein to make up the total tube bundle, with adjacent tube groups such as the groups 132, 148 and 150 sharing one or more tubes 28*a* so that an overlapping of the bands or straps 96*a* between adjacent tubes group will secure and integrate the tube groups together to make up the overall tube bundle. Such overlap strapping to integrate a series of seven-tube groups 148 together in an overall bundle of one hundred nine tubes is illustrated in FIG. 16 and described hereinafter in connection therewith.

FIG. 15 illustrates a buckle-like band clamp 130 which is desirable to use in building up a tube bundle according to the present invention because it is thin in profile, simple in structure and operation, enables the band or strap 96*a* to be cinched up tightly with the use of a suitable strapping tool, and securely locks the ends of the band or strap 96*a* together.

The clamp 130 includes a generally flat, platform-like body 152 which has a buckle loop 154 and also a pair of tangs 156 punched out upwardly therefrom. One end portion 158 of strap 96*a* is passed between loop 154 and body 152 and then between the two tangs 156 and folded down underneath the body 152. The other end portion 160 of band or strap 96*a*, illustrated in phantom in FIG. 15, comes in over the strap end portion 158 between tangs 156 and thence under buckle loop 154, and is cinched up by a strapping tool (not shown) and then folded back over the top of buckle loop 154 and between tangs 156, and the tangs are then closed down over the top of end portion 150 to complete the clamping action. Clamps of this type and suitable strapping tools therefor are obtainable from Band-It Company of Denver, Colo.

Figure 16:
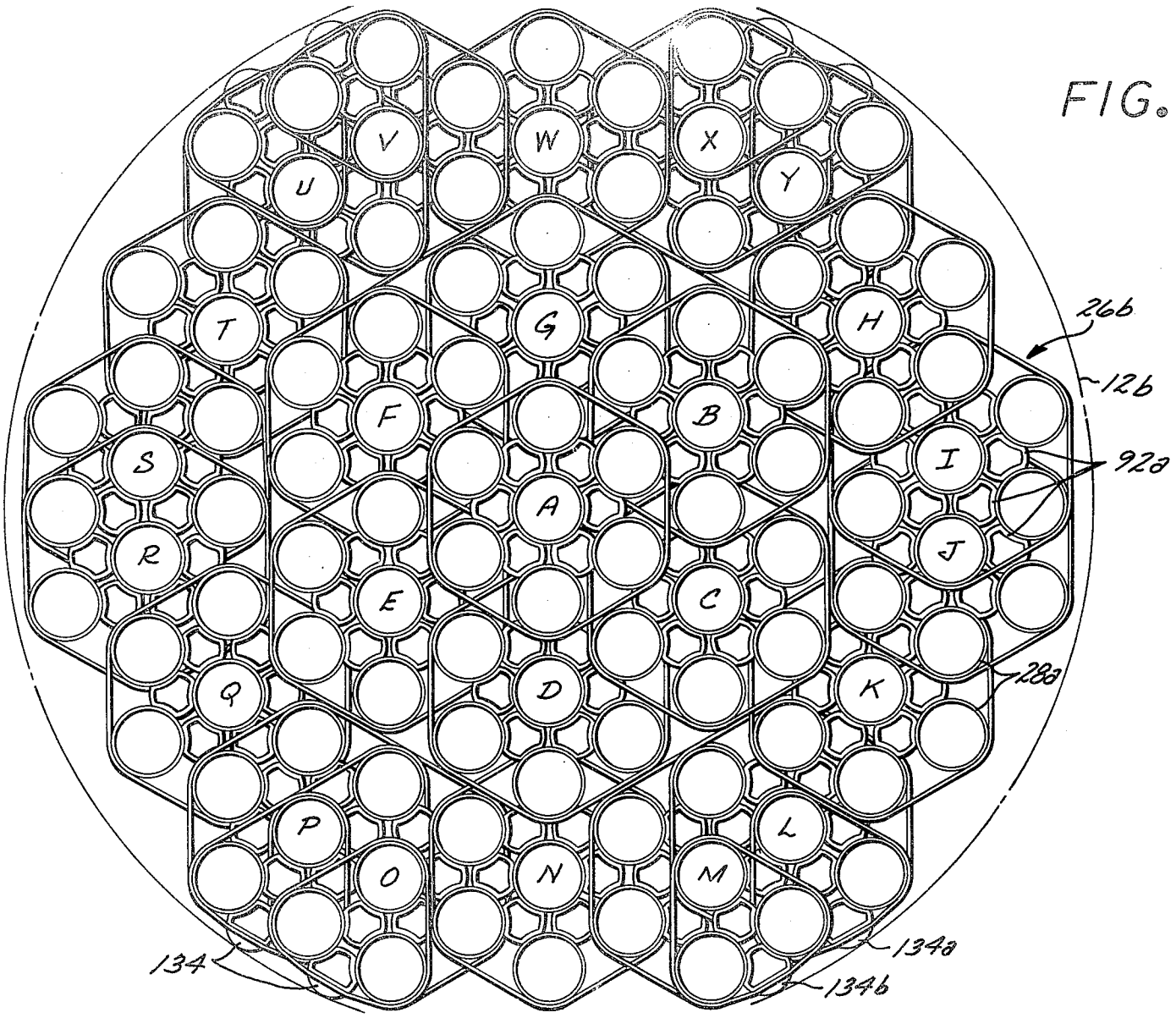
FIG. 16 is a cross-sectional view similar to FIGS. 8, 10, 12 and 14, illustrating a complete, banded assembly of 109 tubes for a heat exchanger, including support feet or skids of the type illustrated in FIGS. 9, 10 and 11.

FIG. 16 illustrates a complete tube bundle 26*b* according to the present invention, consisting of one hundred nine tubes 28*a* spaced apart and located relative to each other by means of tube support members or brackets 92*a* and bands or straps 96*a*, the bundle 26*b* being concentrically located inside heat exchanger shell 12*b* shown in phantom by means of support feet or skids 134. Inasmuch as FIG. 16 shows tube bundle 26*b* in cross section to best illustrate the array, each tube support member or bracket 92*a*, each band or strap 96*a*, and each support foot or skid 134 shown in FIG. 16 represents only one of an axially spaced series of support members 92*a* and their associated bands 96*a*, and support feet 134 and their associated bands 96*a* along the length of the tube bundle 26*b*.

Referring back to FIGS. 11 and 13, it will be noted therein that each tube support member 92*a* of the three-tube group 132 is located at the same axial position along the tube group 132 as a respective band or strap 130; and in the seven-tube group 148 a set of six tube support members 92*a* and an associated band or strap 96*a* are at a common axial location along the length of the tube group 148. Similarly, in the one hundred nine tube bundle 26*a* shown in FIG. 16, for each of the 25 seven-tube groups therein, at each of the strapping locations along the axial length of that seven-tube group there will be a band or strap 96*a* and an associated set of six of the tube support members or brackets 92*a*. However, in some heat exchangers greater spacing between the tubes and consequent further penetration of the support members 92*a* between adjacent tubes may require axial offsetting of adjacent support members to prevent interference therebetween. Such axial offsetting may be accomplished, for example, in the format of the seven-tube group 48 by having one end of each support member 92*a* proximate the axial location of strap 96*a*, with the other ends of successive support members around the center tube staggered in opposite axial directions.

In FIG. 16 four of the support feet or skids 134 are seen at the bottom of tube bundle 26*b* and four of the support feet or skids 134 are seen at the top of tube bundle 26*b*. Eight of the support feet or skids 134 thus located about the periphery of the tube bundle 26*b* provide adequate support of bundle 26*b* inside shell 12*b*; it being understood that each of the support feet or skids 134 seen in FIG. 16 represents only one of a series of such support feet 134 axially spaced along the length of the tube bundle.

In FIG. 16, the twenty-five seven-tube groups 148 are given respective letter designations A through Y, the letter designation for each seven-tube group 148 being placed in the center tube of the group 148. The tube bundle 26*b* represents a concentric array of the twenty-five seven-tube groups 148, the tube group A being centrally located; tube groups B to G being located concentrically around the group A, and each sharing one tube with the center group A and also sharing a tube with each of its neighbors for overlapping of the strapping. The remaining seven-tube groups H through Y are peripherally located about the groups B through G; the groups H, K, N, Q, T, and W each sharing a tube with respective group B, C, D, E, F, and G. Additionally, group H shares two tubes with each of groups Y and I; groups I and J share four tubes; group K shares two tubes with each of groups J and L; groups L and M share four tubes; group N shares two tubes with each of groups M and O; groups O and P share four tubes; group Q shares two tubes with each of groups P and R; groups R and S share four tubes; group T shares two tubes with each of groups S and U; groups U and V share four tubes; group W shares two tubes with each of groups V and X; and groups X and Y share four tubes.

Each of the support feet or skids 134 in tube bundle 26*b* is strapped to a three-tube group 132 in the manner shown in FIGS. 10 and 11. Thus support foot or skid 134*a* is strapped to the triangular tube group 132 consisting of the center and two outermost tubes of the seven-tube group L; while the support foot or skid 134*b* is strapped to the three-tube group 132 consisting of the center and two outermost tubes of the seven-tube group M.

Where a tube bundle such as bundle 26*b* of FIG. 16 has a large number of concentrically arranged tube groups, the bundle leads itself to both a helical and a spiral arrangement of the support members or brackets 92*a* for inducing a slight helical and spiral mixing action in the shell side fluid as it passes about the tubes 28*a* without materially reducing velocity or increasing pressure drop. In a seventy-foot long heat exchanger embodying the 109 tube bundle 26*b* of FIG. 16, a suitable number of axially spaced straps 130 for each seven-tube group 148 is eight straps, and each of the eight straps will encompass a set of six tube support members 92*a* in the manner shown in FIG. 12. The following chart gives the strap locations for the first four successive straps in inches from the inside of the floating tube sheet for each of the twenty-five tube groups A to Y, in a suitable bundle strapping arrangement that embodies both helical and spiral components:

| Tube Group Letter | Distance in Inches to Straps from Inside Floating Tube Sheet | | | |
|---|---|---|---|---|
| | 1st STRAP | 2nd STRAP | 3rd STRAP | 4th STRAP |
| A | 65.50 | 166.25 | 267.00 | 367.75 |
| B | 67.00 | 167.75 | 268.50 | 369.25 |
| C | 68.50 | 169.25 | 270.00 | 370.75 |
| D | 70.00 | 170.75 | 271.50 | 372.25 |
| E | 71.50 | 172.25 | 273.00 | 373.75 |
| F | 73.00 | 173.75 | 274.50 | 375.25 |
| G | 74.50 | 175.25 | 276.00 | 376.75 |
| H | 76.00 | 176.75 | 277.50 | 378.25 |
| I | 77.50 | 178.25 | 279.00 | 379.75 |
| J | 79.00 | 179.75 | 280.50 | 381.25 |
| K | 80.50 | 181.25 | 282.00 | 382.75 |
| L | 82.00 | 182.75 | 283.50 | 384.25 |
| M | 83.50 | 184.25 | 285.00 | 385.75 |
| N | 85.00 | 185.75 | 286.50 | 387.25 |
| O | 86.50 | 187.25 | 288.00 | 388.75 |
| P | 88.00 | 188.75 | 289.50 | 390.25 |
| Q | 89.50 | 190.25 | 291.00 | 391.75 |
| R | 91.00 | 191.75 | 292.50 | 393.25 |
| S | 92.50 | 193.25 | 294.00 | 394.75 |
| T | 94.00 | 194.75 | 295.50 | 396.25 |
| U | 95.50 | 196.25 | 297.00 | 397.75 |
| V | 97.00 | 197.75 | 298.50 | 399.25 |
| W | 98.50 | 199.25 | 300.00 | 400.75 |
| X | 100.00 | 200.75 | 301.50 | 402.25 |
| Y | 101.50 | 202.25 | 303.00 | 403.75 |

In this same tube bundle 26*b* that has an axial series of eight straps 96*a* and associated tube support members 92*a* for each tube group, an axial series of nine support feet 134 corresponding to each of the support feet 134 shown in FIG. 16 provides a satisfactory number of support feet 134, and these can be axially offset in the bundle 26*b* from immediately adjacent support feet 134 to avoid any interference between the support foot straps 96*a*.

It will, of course, be understood that various changes may be made in the form, details, arrangement and proportions of the components without departing from the scope of the invention.

What is claimed is novel and unobvious and is desired to be protected by Letters Patent as set forth in the appended claims.

I claim:

1. In a shell and tube type heat exchanger including a bundle of generally parallel heat exchange tubes contained within a shell, means for supporting a plurality of said tubes as a group in spaced-apart relationship which comprises:

a tubular support member engaged between said plurality of tubes, said support member being located between said plurality of tubes solely by means of its said engagement therebetween, said support member having passage means extending therethrough generally parallel to said plurality of tubes, and means for holding said plurality of tubes against the exterior of said support member.

2. Apparatus as defined in claim 1, wherein said holding means comprises strap means engaged around the outside of said group of tubes.

3. Apparatus as defined in claim 1, wherein said support member comprises a plurality of concave exterior surfaces corresponding in number to the number of tubes in said group, each of said tubes in said group being engaged in a respective said concave surface.

4. Apparatus as defined in claim 3, wherein said concave surfaces are arcuate and generally complementary to the outer peripheries of the respective tubes.

5. Apparatus as defined in claim 3, wherein said support member comprises three of said concave surfaces and said group of tubes comprises three tubes.

6. Apparatus as defined in claim 3, wherein said support member has a generally triangular cross section.

7. Apparatus as defined in claim 6, wherein said support member has a generally equilateral triangular cross section.

8. Apparatus as defined in claim 1, which comprises a group of seven of said tubes in a concentric, generally hexagonal array, wherein six of said tubes are peripherally located around a seventh, centrally located tube by means of six of said support members annularly arranged about said seventh tube.

9. Apparatus as defined in claim 8, wherein each of said support members has three exterior concave surfaces and is engaged between an adjacent pair of said peripheral tubes and said centrally located tube.

10. In a shell and tube type heat exchanger including a bundle of generally parallel heat exchange tubes contained within a shell, means for supporting a plurality of said tubes as a group in spaced-apart relationship which comprises:

a tubular support member engaged between said plurality of tubes, said support member having passage means extending therethrough generally parallel to said plurality of tubes, and means for holding said plurality of tubes against the exterior of said support member, said support member comprising a plurality of concave exterior surfaces corresponding in number to the number of tubes in said group, said concave surfaces being arcuate and generally complementary to the outer peripheries of the respective tubes, each of said tubes in said group being engaged in a respective said concave surface, said arcuate concave surfaces being defined by spring portions of said support member and having a greater initial radius of curvature than the peripheries of the tubes, force of said holding means on the tubes urging said concave surfaces toward conformation to the curvature of said tubes to produce a spring biasing deflection of said spring portions of the support member.

11. In a shell and tube type heat exchanger including a bundle of generally parallel heat exchange tubes contained within a shell, means for supporting a plurality of said tubes as a group in spaced-apart relationship which comprises:

a tubular support member engaged between said plurality of tubes, said support member having passage means extending therethrough generally parallel to said plurality of tubes, and means for holding said plurality of tubes against the exterior of said support member, a plurality of said support members being arranged in a generally helical pattern along the length of said tube bundle.

12. Apparatus as defined in claim 11, wherein said support members are also arranged in a generally spiral pattern along the length of said tube bundle.

13. In a shell and tube type heat exchanger including a bundle of generally parallel heat exchange tubes contained within a shell, means for supporting a plurality of said tubes as a group in spaced-apart relationship which comprises;

a tubular support member engaged between said plurality of tubes, said support member having passage means extending therethrough generally parallel to said plurality of tubes, and means for holding said plurality of tubes against the exterior of said support member, said holding means comprising strap means engaged around the outside of said group of tubes, a plurality of said groups of tubes making up said bundle, each of said groups of tubes sharing at least one tube with at least one adjacent group to provide overlapping of the strap means between adjacent groups.

14. In a shell and tube type heat exchanger including a bundle of generally parallel heat exchange tubes contained within a shell, means for supporting a plurality of said tubes as a group in spaced-apart relationship which comprises:

a tubular support member engaged between said plurality of tubes, said support member having passage means extending therethrough generally parallel to said plurality of tubes, and means for holding said plurality of tubes against the exterior of said support member, a group of seven of said tubes being in a concentric, generally hexagonal array, wherein six of said tubes are peripherally located around a seventh, centrally located tube by means of six of said support members annularly arranged about said seventh tube, a plurality of said groups of seven said tubes making up said tube bundle, said holding means comprising strap means engaged around the outside of each of said groups, each of said groups of tubes sharing at least one tube with at least one adjacent group to provide overlapping of the strap means between adjacent groups.

* * * * *